US008578614B2

(12) United States Patent
Hernandez

(10) Patent No.: US 8,578,614 B2
(45) Date of Patent: Nov. 12, 2013

(54) RATCHETING TOOL WITH ANGULAR POSITIONING HANDLES FOR CUTTING NON-METAL PIPE AND TUBING

(76) Inventor: Rigoberto Hernandez, North Palm Beach, FL (US)

( * ) Notice: Subject to any disclaimer, the term of this patent is extended or adjusted under 35 U.S.C. 154(b) by 694 days.

(21) Appl. No.: 12/131,414

(22) Filed: Jun. 2, 2008

(65) Prior Publication Data

US 2009/0293288 A1 Dec. 3, 2009

(51) Int. Cl.
*B26B 17/00* (2006.01)

(52) U.S. Cl.
USPC ..... 30/184; 30/185; 30/192; 30/251

(58) Field of Classification Search
USPC ..... 30/184, 185, 99, 251, 255, 252, 245, 30/266, 192; 81/314, 337, 338
See application file for complete search history.

(56) References Cited

U.S. PATENT DOCUMENTS

| | | | | |
|---|---|---|---|---|
| 733,919 | A | 7/1903 | Schwartz | |
| 869,949 | A | 11/1907 | Westerdahl | |
| 894,710 | A * | 7/1908 | Selley | 30/257 |
| 2,020,242 | A | 11/1935 | Geddes | |
| 2,697,875 | A | 12/1954 | McIver | |
| 3,596,355 | A * | 8/1971 | Wertepny, Sr. | 30/252 |
| 4,176,450 | A * | 12/1979 | Muromoto | 30/92 |
| 4,674,184 | A | 6/1987 | Anderson | |
| 5,129,158 | A * | 7/1992 | Campagna | 30/92 |
| 5,317,806 | A | 6/1994 | Held et al. | |
| 5,974,670 | A | 11/1999 | Hsieh | |
| 6,249,976 | B1 | 6/2001 | Osame | |
| 6,658,738 | B1 | 12/2003 | King | |
| 6,662,451 | B1 | 12/2003 | Cheng | |
| 6,766,581 | B2 | 7/2004 | Nordlin | |
| 7,007,387 | B2 * | 3/2006 | Kuzuu | 30/28 |
| 7,127,819 | B1 * | 10/2006 | Huang | 30/92 |
| 2002/0042997 | A1 * | 4/2002 | Uhl | 30/382 |

* cited by examiner

*Primary Examiner* — Omar Flores Sanchez
(74) *Attorney, Agent, or Firm* — McHale & Slavin, P.A.

(57) ABSTRACT

Disclosed is an improved pipe cutting tool based upon a ratchet closure action wherein handles are pivotedly attached to allow successive movement of a cutting blade in response to the squeezing of the handles. The handles are also hingedly coupled to the cutting member to maintain the cutting member in a position perpendicular to the tubular item to be cut while allowing the operator to squeeze the handles at offset angles, up to and including a right angle cut. The hinged handles allow for offset operation without forgoing the ease of operation by the consumer or causing a large reduction in the mechanical advantage. A ratchet allows sequential advancement of a cutting member toward a tubular shaped jaw that holds the item to be cut.

12 Claims, 4 Drawing Sheets

RATCHETING TOOL WITH ANGULAR POSITIONING HANDLES FOR CUTTING NON-METAL PIPE AND TUBING

FIELD OF THE INVENTION

This invention relates to hand tools for cutting non-metal pipe and tubing and, in particular, to an improved ratcheting cutter tool having angular positioning handles to permit offset operation.

BACKGROUND OF THE INVENTION

The use of cutter tools is a necessity for efficient installation of new or replacement non-metal pipes and tubing. While there are numerous types of cutters, ratchet style cutter tools have become well accepted by the industry and the consuming public. The ratchet style cutter tool is commonly used for ABS and PVC piping, rubber and neoprene hoses, and the like non-metal piping and tubing.

Ratchet style cutter tools are well known in the art. Early ratchet tools include the use of teeth to provide unidirectional movement of the cutting tool such as that disclosed in U.S. Pat. No. 2,697,875.

U.S. Pat. No. 5,129,158 discloses a plastic pipe cutter having a guillotine style cutting action.

A ratchet style cutter tool typically consists of a hand operated device that resembles a large scissors. The use of a ratchet mechanism permits a mechanical advantage in the cutting action by disseminating the cutting action over a series of steps cuts. For instance, U.S. Pat. Nos. 4,176,450 and 4,674,184 disclose cutting tools having a movable blade that is pivotally mounted to a support anvil. The anvil provides an area for securement of the pipe or tube effectively positioning the material from movement during the outward force caused by the pivoting motion of a cutting blade. The cutting blade is drawn into the material by a stepped advancement providing leverage efficiency through movement of the cutter blade into various cutting points with the sequential squeezing of handles.

Ratcheting type cutters reduce the hand force required in operation of cutting action. By squeezing the cutter tool handles, the operator produces only a partial cutting movement of the blade. Sequential actuations are required in order to advance the blade through the material to be cut. The use of the ratcheting type cutter tool takes mechanical advantage of the handle in relation to the cutting blade to provide a leveraged scissor type action. Ratchet teeth are arranged such that the mechanical advantage given each tooth increases the leverage point as the handles are squeezed. The ratchet teeth are sized and positioned to cause the cutting blade to travel through the material to be cut with a mechanical advantage force not possible with a one-to-one pivot operation found in a conventional scissors.

U.S. Pat. No. 6,766,581 discloses a cutter having a movable jaw that advances every time the handles of the tool is closed.

A non-ratcheting cutter is illustrated by U.S. Pat. No. 6,658,738 wherein leverage is obtained by movement of a pivot point allowing the handle to be operated at different angles to the material to be cut.

A problem with the prior art cutting tool is that cutting of the material must be made by placement of the cutting blade at a perpendicular angle to the pipe so as to provide a proper splice point for a coupling, elbow, or the like fitting that may be attached to the cut pipe. If the pipe is not cut at a perpendicular angle, valuable surface area is lost and the possibility of leaks increases. The operator must take care to position the cutting tool perpendicular to the material to be cut. In many instances it may not be possible or practical to position the tool in the perpendicular position. The position may be such that operation of the tool handle may be inhibited due to fixed objects that would be costly or not practical to move. For instance, if a plastic pipe was placed in a crawl space with the piping running along a side wall, it may not be possible to place a cutter tool perpendicular to the pipe. Similarly, a water pipe made of plastic might have broken behind shrubs wherein offset cutting operation is possible, but perpendicular placement of the cutting tool would require movement of the shrub.

U.S. Pat. No. 6,662,451 discloses a hedge shears having a pair of blades that are rotatably secured to the handles. The angular positioning of the blades allows for offset cutting angles.

U.S. Pat. No. 733,919 discloses an implement handle having an hinge pivot that allows operation of the handle at an offset angle to the cutting blades.

U.S. Pat. No. 869,949 discloses a scissors having a hinged handle to allow offset cutting, the hinge handle having apertures for securing the handles to the blades at predisposed positions.

U.S. Pat. No. 2,020,242 discloses a crimper/cutter tool having handles adjustable to the blades.

U.S. Pat. No. 894,710 discloses a garden shears having having a pair of blades that are hingedly secured to the handles. The hinge allows positioning of the handles to allow offset operation of the blades.

U.S. Pat. No. 3,596,355 discloses a shearing tool having a handles hingedly coupled to the cutting blades.

U.S. Pat. No. 5,974,670 discloses a multipurpose cutting tool having two pivoted cutter blades turned with two handles. A ratchet allows one cutter blade to move in response to a first handle movement.

U.S. Pat. No. 6,249,976 discloses a scissors that permits offset cutting by placement of a hinge between the handles and the cutting blades.

U.S. Pat. No. 5,317,806 discloses a pruning shears connected by use of a swivel joint along the end of a guide handle. The swivel joint includes a hinge pin and traction cable. The arms of the shears can be locked in any angular position of the swivel joint.

Thus, what is needed in the art is a ratchet cutting tool capable of operating at offset angles while maintaining the cutting blade in a perpendicular angle.

SUMMARY OF THE INVENTION

Disclosed is an improved pipe cutting tool having a ratchet based closure with handles pivotally attached at a first point to fit an average individual's hand and along a second point to permit successive advancement of a cutting blade in response to the squeezing of the handles. The handles are hingedly coupled to allow positioning of the cutting member along a position perpendicular to the material to be cut allowing the operator to squeeze the handles along predetermining offset angles. In the preferred embodiment, the offset angles can be locked in position along a 45 or 90 degree angle from either side of the perpendicular position. The hinged handles allows for offset operation without loss of the mechanical advantage found in conventional cutter tools.

Thus, an objective of the invention is to provide a cutting tool that allows blade advancement by use of handles positioned perpendicular, at a 45 degree or at 90 degree offset angle.

Still another objective of the instant invention is to provide an improved cutting tool using a mechanical advantage ratchet while the cutting blade and handles are positioned at different angles.

Another objective of the instant invention is to provide a cutting tool that provides mechanical advantage by inclusion of a two pivot point handle.

Yet still another objective of the invention is to teach the use of a cutting tool that allows the application of force from the squeezing of the handles to be applied through a dual hinged joint for drawing of the cutting blade through the pipe or tube to be severed.

These and other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE PREFERRED EMBODIMENT

Figure 1:
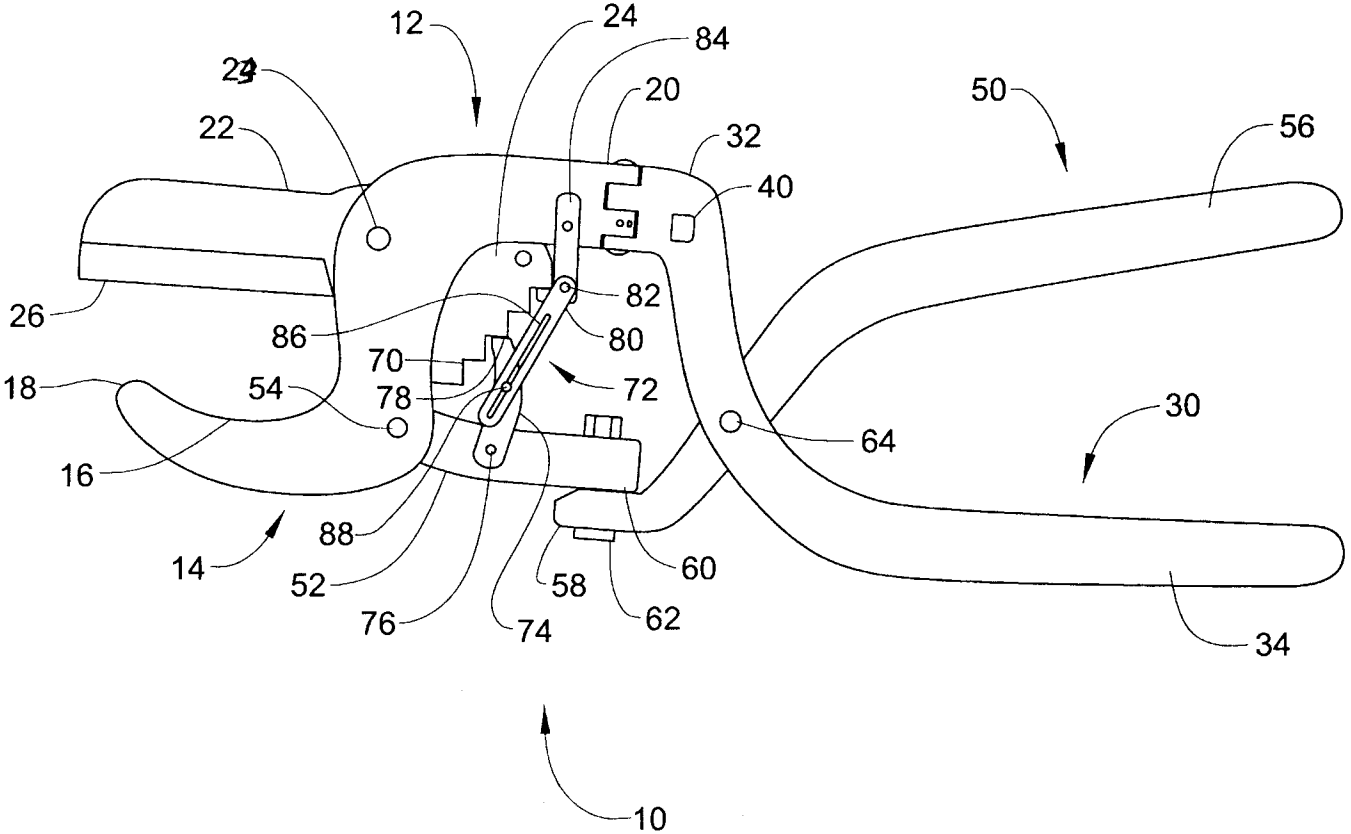
FIG. 1 is a left side plane view of the cutting tool.

Now referring to the figures, set forth is the cutter tool (10) of the instant invention formed from a base member (12) having a rigid s-shaped support section (14) defining a tubular shaped jaw (16) along a first end (18) and a hinge point second end (20). The base member (12) is the mounting platform for cutting member (22) which is pivotally secured to the S-shaped support section (12) along pivot point (23). Preferably the cutting member is formed integral with a ratchet plate (24) wherein movement of the ratchet plate (24) is performed by a step function, as explained later in this specification, and results in a direct movement of the cutter member (22) in a downward position wherein cutting blade (26) is press against the material to be cut, such as a pipe or tube, placed within the jaw section (16) so as to position the material from the advancement of the cutting blade to cause the appropriate severance.

A first handle (30) has an upper end (32) which is hingedly secured to the second end (20) of the base member (14). The first handle (30) includes a lower grip end (34) positioned substantially parallel to tubular shaped jaw member (16). The first handle (30) may be angularly positioned to the base member setting of the positional slide (40). Slide (40) may engage the hinge (20) by use of a pinion (42) so as to cause locking of the handle (30), in relation to the base member (14), at a right angle 9° position, a 30° angle, or with no angle. The hinge allows placement of the handle either to the left or the right of the cutting blade. It should be noted that most any angle can be included in the positioning and is simply a function of receptacle placement into the base member for receipt of the pinion (42). The hinge rotates around pinion (21).

The base member is further attached to a second handle (50) by use of a coupling post (52) which is secured to the base member (14) as shown by engagement rivet (54). It should be noted that the coupling post may be formed integral with the base member (14); the use of the coupling post (52) is for ease of manufacturing purposes only. The second handle (50) includes an upper grip (56) having a first end (58) pivotally secured by use of a spherical bearing to a distal end (60) of the coupling post (52) by use of pivot pin (62). The lower grip (34) and upper grip (56) form a scissors action with rotation along pivot (64). The positioning of grip (34) by the positioner slider (40) results in the equal positioning of upper grip (56) as caused by the joining of the handles on pivot point (64).

The ratchet plate (24) includes a series of teeth (70) that operate in conjunction with the actuator (72). The actuator (72) will slide back to release the blade. The actuator has an engagement post (74) pivotally attached to the coupling post (52) at a lower end by pivot point (76). The upper end (78) is used to engage each step (70) formed by the teeth and upon squeezing of the handle grips (34 and 56) causes a sequential movement of the cutting blade (26) in juxtaposition with jaw member (16) the range permitted by the size of each step (70) of the teeth. Upon releasing the pressure of the grips (34 and 56) post (74) steps to the next available step by actuator placement (80) having an upper end (82) pivotally attached to extension post (84). The alignment bar includes a slot (86) which is secured along pinion point (82) at one end and slidably secured to (74) by use of slide pin (88).

Figure 2:
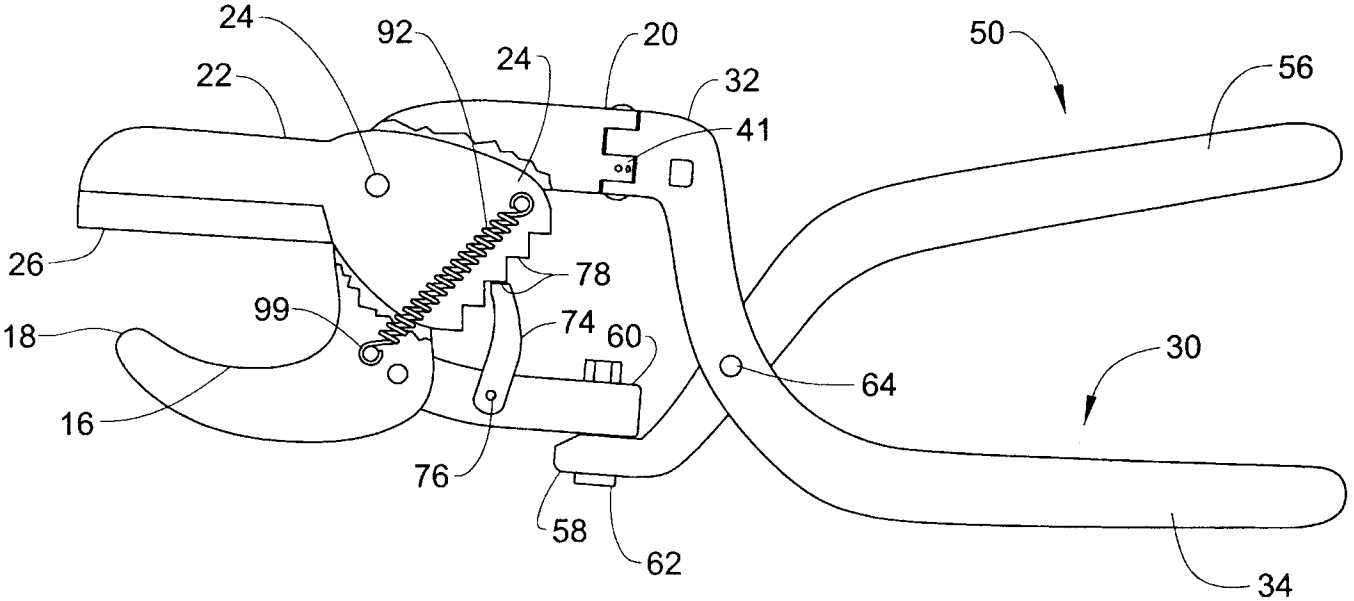
FIG. 2 is a right side plane view of the cutting tool.
Figure 3:
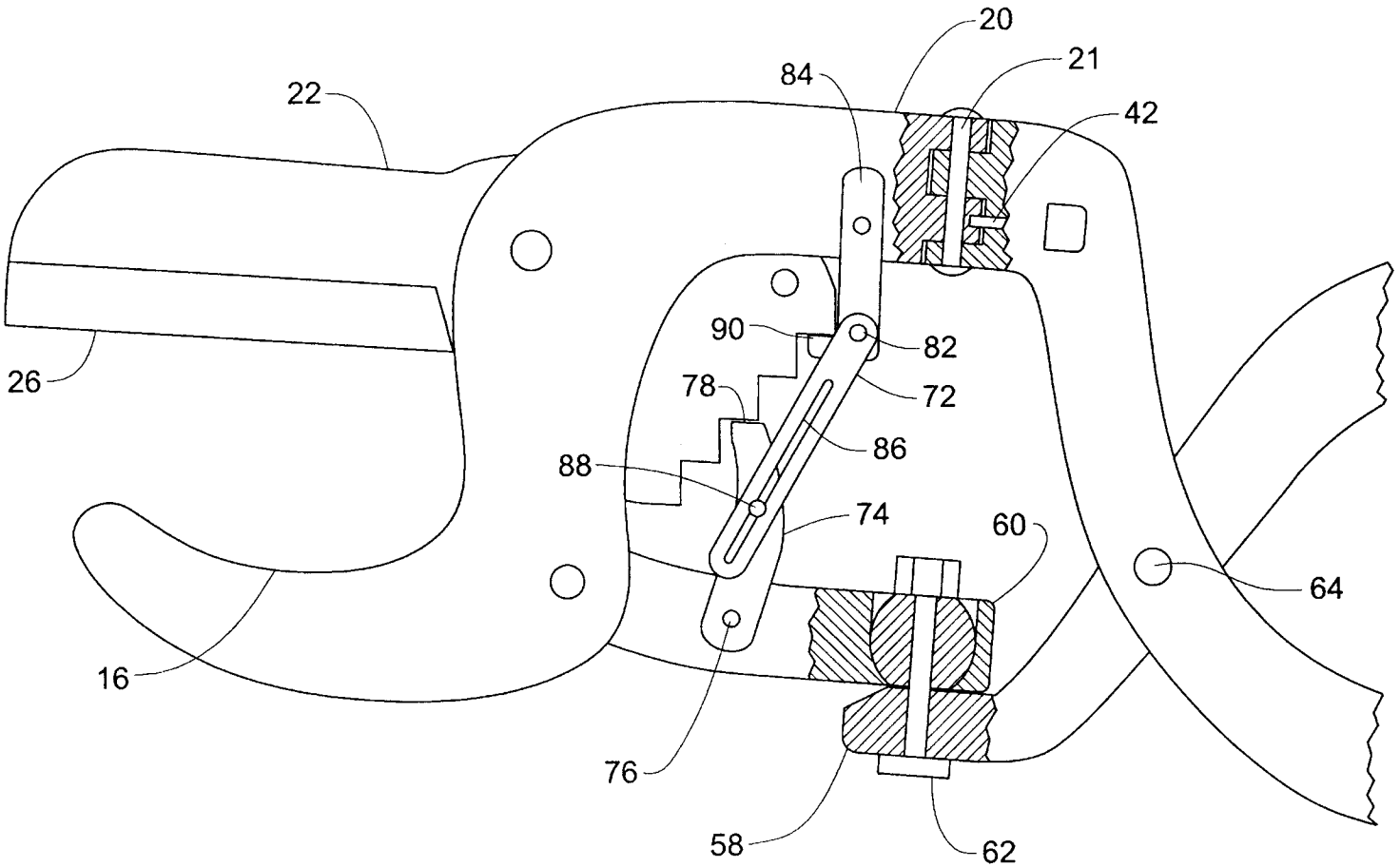
FIG. 3 is an enlarged left side view of the hinged handles and actuator.

Extension post (84) includes a reverse step (90) for engagement of the ratchet plate for purposes of separating the cutting member (22) from the jaw (16) for releasing the tool from the tube or pipe or for use when the item is to be first opened for purposes of engaging the size of the tube or pipe. A spring (92) is attached to the ratchet plate (24) and lower jaw member (16) or engagement point (96) which allows ease of opening the cutter member from the jaw for use in setting of the tool to a pipe or tube upon completion of a cutting operation. The spring locks the blade in an engaged position during the cutting action. The ratchet plate depicted in FIG. 2 is shown in a cut-away view for illustrating the operation of the spring. The actual tool includes the positioning of the ratchet plate within the base member so that the spring is not exposed to view, or in a position that would otherwise impede operation of the tool in close quarters.

Figure 4:
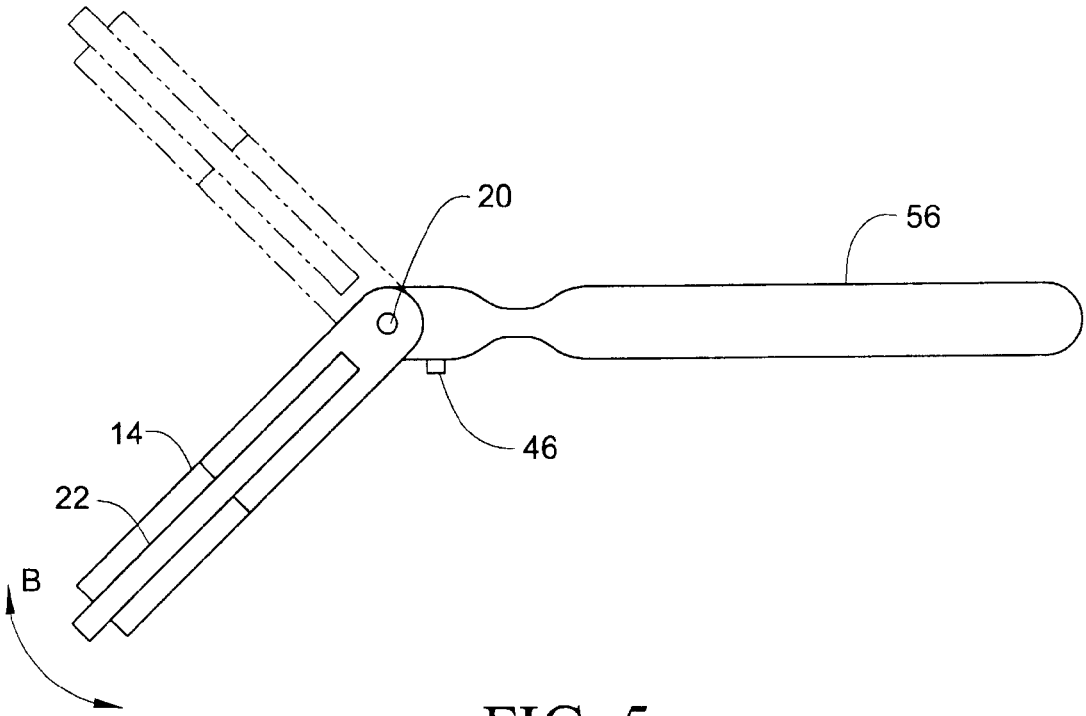
FIG. 4 is a top view showing the cutting tool placed in a 45 degree position.
Figure 5:
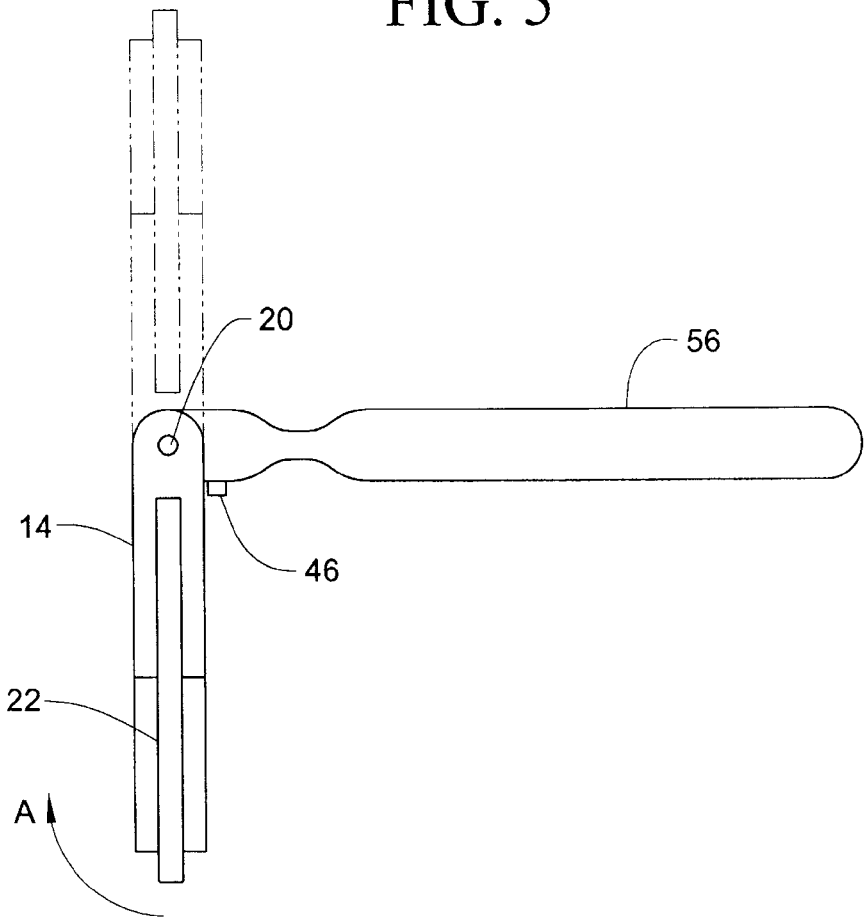
FIG. 5 is a top view showing the cutting tool placed in a 90 degree position.

Referring to FIG. 4, set forth is a top view depicting the movement of the support member 14 and cutter member 22 around pivot point 20. The illustration depicting the handle 56 placed at about the 45 degree angle "B" to either the left or right side of the handle. The offset allowing an individual to operate the tool at a 45 degree angle to the material to be cut. Referring to FIG. 5, set forth is a top view depicting the movement of the support member 14 and cutter member 22 around pivot point 20. The illustration depicting the handle 56 placed at about the 90 degree angle "A" to either the left or right side of the handle. The offset allowing an individual to operate the tool at a 90 degree angle to the material to be cut. As previously mentioned, the 45 and 90 degree position is for illustration purpose only. Operation of the tool can be adjusted for use at any angle, including greater than 90 degrees.

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

All patents and publications mentioned in this specification are indicative of the levels of those skilled in the art to which the invention pertains. All patents and publications are herein incorporated by reference to the same extent as if each individual publication was specifically and individually indicated to be incorporated by reference. It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the stated claims or objectives.

What I claim is:

1. A tool for cutting non-metal pipe or tubing comprising:

a base member formed from a rigid S-shaped support section having a tubular shaped jaw along a first end for receipt of tubular items to be cut and a second end;

a first handle having an upper end pivotally secured to said second end of said base member for rotation about a hinge point substantially parallel to said tubular shaped jaw;

a cutting member pivotedly secured to said S-shaped support section and operatively associated with said tubular shaped jaw;

a coupling post pivotedly secured to said base member via a fastener member at a first end thereof for substantially aligned sequential rotation with respect to said tubular shaped jaw and a distal end;

a second handle having a first end operatively engaging said distal end of said coupling post and an upper grip end;

a multiaxial connection between said first end of said second handle and said coupling post;

a pivot point coupling said lower grip end and said upper grip together; and a ratchet means allowing sequential advancement of said cutting member toward said tubular shaped jaw;

wherein the sequential squeezing of said upper and lower grip ends causes the pivotal movement of said cutting member over said tubular shaped jaw for cutting of any tubular shaped item placed therebetween.

2. The tool for cutting according to claim 1 wherein ratchet means includes a ratchet plate secured to said S-shaped support and an actuator pivotedly secured to said coupling post.

3. The tool for cutting according to claim 2 wherein ratchet plate has a plurality of teeth allowing sequential movement of said cutter member upon engagement of said actuator, said actuator engaging said teeth to cause movement upon the squeezing of the upper and lower grips.

4. The tool for cutting according to claim 2 wherein said cutting member is formed integral with said ratchet plate.

5. The tool for cutting according to claim 1 wherein said multiaxial connection is a spherical ball and pin, said multiaxial connection providing a range of motion along several different axes to allow movement of each said grip to a position perpendicular to said cutting member.

6. The tool for cutting according to claim 1 including a spring secured to said ratchet plate and said jaw member, said spring biasing directional movement of said cutter member to said jaw during a cutting operation.

7. A tool having angular positioning handles for cutting non-metal pipe or tubing comprising:

a base member formed from a rigid S-shaped support section having a tubular shaped jaw along a first end for receipt of tubular items to be cut and a second end;

a first handle having an upper end hingedly secured to said second end of said base member and a lower grip end;

a cutting member pivotally secured to said S-shaped support section and operatively associated with said tubular shaped jaw;

a coupling post pivotedly secured to said base member;

a second handle having a first end a multiaxial connection between said first end of said second handle and said coupling post;

a pivot point coupling said lower grip end and said upper grip together;

a ratchet plate secured to said S-shaped support; and an actuator pivotally secured to said coupling post, said actuator operatively associated with said ratchet plate to allow sequential advancement of said cutting member toward said tubular shaped jaw, said hinge placement allows movement of each said grip to a position perpendicular to said cutting member;

wherein the sequential squeezing of said upper and lower grip ends throughout an angular range allowed by said hinge causes the pivotal movement of said cutting member over said tubular shaped jaw for cutting of any tubular shaped item placed therebetween.

8. The tool having angular positioning handles for cutting according to claim 7 wherein ratchet plate has a plurality of teeth allowing sequential movement of said cutter member upon engagement of said actuator, said actuator engaging said teeth to cause movement upon the squeezing of the upper and lower grips.

9. The tool having angular positioning handles for cutting according to claim 7 wherein said cutting member is formed integral with said ratchet plate.

10. The tool having angular positioning handles for cutting according to claim 7 wherein each said hinge is positioned to provide optimum leverage movement of each said grip to a position perpendicular to said cutting member.

11. The tool having angular positioning handles for cutting according to claim 7 including a spring secured to said ratchet plate and said jaw member, said spring biasing directional movement of said cutter member to said jaw during a cutting operation.

12. The tool for cutting according to claim 7 wherein said multiaxial connection is a spherical ball and pin, said multiaxial connection providing a range of motion along several different axes to allow movement of each said grip to a position perpendicular to said cutting member.

* * * * *